US011351408B2

(12) United States Patent
Landsman et al.

(10) Patent No.: US 11,351,408 B2
(45) Date of Patent: Jun. 7, 2022

(54) ADJUSTABLE HEIGHT BALANCE BEAM

(71) Applicant: Milliard Enterprises Limited Liability Company, Lakewood, NJ (US)

(72) Inventors: Yaakov Landsman, Lakewood, NJ (US); Simcha Bunim Newmark, Lakewood, NJ (US); Sima Kulik, Toms River, NJ (US); Juan Meng, Cangzhou (CN); Jinfeng Zhang, Cangzhou (CN); Minsong Wang, Cangzhou (CN); Haiyan Yu, Cangzhou (CN); Huang Pan, Xingsha Town (CN)

(73) Assignee: Milliard Enterprises Limited Liability Company, Lakewood, NJ (US)

( * ) Notice: Subject to any disclaimer, the term of this patent is extended or adjusted under 35 U.S.C. 154(b) by 0 days.

(21) Appl. No.: 16/523,101

(22) Filed: Jul. 26, 2019

(65) Prior Publication Data

US 2020/0078627 A1 Mar. 12, 2020

Related U.S. Application Data

(60) Provisional application No. 62/729,129, filed on Sep. 10, 2018.

(51) Int. Cl.
*A63B 4/00* (2006.01)

(52) U.S. Cl.
CPC ..... *A63B 4/00* (2013.01); *A63B 2225/093* (2013.01)

(58) Field of Classification Search
CPC ..... A63B 22/14; A63B 22/16; A63B 22/18; A63B 22/20; A63B 22/201; A63B 22/203;

(Continued)

(56) References Cited

U.S. PATENT DOCUMENTS 2,932,510 A * 4/1960 Kravitz ..... A63B 3/00 482/17
3,510,129 A 5/1970 Reuther
(Continued)

OTHER PUBLICATIONS

Nimble Sports, Adjustable Brace Balance Beam [online], Publish Date: Dec. 7, 2016. Retrieved from the Internet <URL: https://www.youtube.com/watch?v=AJe-h6YRZc8 > (Year: 2016).*

*Primary Examiner* — Nyca T Nguyen
*Assistant Examiner* — Zachary T Moore
(74) *Attorney, Agent, or Firm* — William G. Heedy; The Van Winkle Law Firm

(57) ABSTRACT

An adjustable height balance beam includes an elongate member; opposing upper and lower support columns; opposing base bars; wherein opposing attachment zones of the elongate member are configured for selective attachment to each of the opposing upper support columns, defining a first configuration, and wherein each of the opposing lower support columns is configured for attachment to the corresponding opposing base bars, and the respective opposing base bars, defining a second configuration, for selective height adjustment of the elongate bar relative to the opposing base bars; wherein the height of the elongate bar relative to the opposing base bars may be selectively adjusted when in the first configuration by aligning tension knob ports on the lower support column with a correspondingly selected one of the plurality of linearly displaced apertures on the upper support column to form an aligned attachment channel that is configured for receipt of the tension knob.

15 Claims, 4 Drawing Sheets

(58) Field of Classification Search
CPC ..... A63B 22/208; A63B 2022/185; A63B 2022/206; A63B 21/00047; A63B 21/0005; A63B 21/00054; A63B 21/4029; A63B 1/00; A63B 1/005; A63B 3/00; A63B 4/00; A63B 2026/006; A63B 2210/50; A63B 2210/54; A63B 2210/58; A63B 2225/09; A63B 2225/093; E06C 1/10; E06C 1/32; E06C 1/381; E04G 1/00; E04G 1/06; E04G 1/14
USPC ..... 482/38; 182/179.1, 178.1
See application file for complete search history.

(56) References Cited

U.S. PATENT DOCUMENTS

| | | | | |
|---|---|---|---|---|
| 4,105,201 | A * | 8/1978 | L'Ecuyer | A63B 4/00 482/34 |
| 5,616,102 | A * | 4/1997 | Lahmann | A63B 4/00 434/258 |
| 5,885,189 | A | 3/1999 | Lane et al. | |
| 6,168,549 | B1 | 1/2001 | Squibb et al. | |
| 7,637,851 | B1 * | 12/2009 | Lormil | A63B 21/4035 482/141 |
| D667,904 | S * | 9/2012 | DeFrancisci | D21/691 |
| 2003/0069112 | A1 * | 4/2003 | Williams | A63B 21/156 482/99 |
| 2010/0190612 | A1 * | 7/2010 | Cook | A63B 71/023 482/148 |
| 2017/0120099 | A1 * | 5/2017 | Biddix, Jr. | A63B 23/1218 |

* cited by examiner

ADJUSTABLE HEIGHT BALANCE BEAM

RELATED APPLICATION

This application claims priority to and incorporates entirely by reference U.S. Provisional Patent Application Ser. No. 62/729,129 filed on Sep. 10, 2018.

BACKGROUND OF THE INVENTION

Balance beams are widely known pieces of exercise equipment most commonly used in connection with gymnastics. Balance beams are a generally thin, elongate beam which is typically raised from the floor in accordance with a particular distance. The standard international height from the ground for a balance beam is 125 centimeters (4' 10"). When first becoming acquainted with maneuvering on a balance beam, gymnasts will practice on a "low" beam that is not raised to standard height for safety purposes. Such is also true for experienced gymnasts who are learning new movements.

With specific applicability to less experienced gymnasts, a balance beam which is adjustable in height would be beneficial. While attempts have been made to meet this need, such as the balance beam described in U.S. Pat. No. 6,077,195, which are useful for their intended purpose, they are generally quite expensive to manufacture and, subsequently, to purchase or the end user.

Accordingly, there exists a need for a low-cost, easily adjustable balance beam that provides a plurality of balance beam height settings.

SUMMARY OF THE INVENTION

In accordance with one form of the invention there is provided an adjustable height balance beam including an elongate member having opposing attachment zones; first and second opposing upper support columns and first and second opposing lower support columns each extending from a first end defining an attachment base and a second end, wherein the respective upper and lower support columns are each structured and disposed for congruent receipt at respective second ends; each of the opposing upper support columns forming a plurality of apertures each being linearly displaced from each other; each of the opposing lower support columns forming a tension knob port; first and second tension knobs each having a protruding member sized and configured for engaged receipt with each of the plurality of apertures on the opposing upper support columns and the tension knob ports on the opposing lower support columns; first and second opposing base bars each having at least one attachment point; wherein the opposing attachment zones of the elongate member are sized and configured for selective attachment to each of the attachment bases of the opposing upper support columns and wherein each of the attachment bases of the opposing lower support columns is sized and configured for attachment to the corresponding at least one attachment points on the opposing base bars, defining a first configuration; wherein the height of the elongate bar relative to the opposing base bars may be selectively adjusted when in the first configuration by aligning the tension knob ports with a correspondingly selected one of the plurality of linearly displaced apertures on the upper support column to form an aligned attachment channel that is sized and configured for engaged receipt of the tension knob for securing the elongate bar at a particular height relative to the opposing base bars; and wherein the opposing attachment zones of the elongate member are sized and configured for selective attachment to the respective at least one attachment points of the opposing base bars, defining a second configuration.

In accordance with another form of the invention there is provided an adjustable height balance beam including an elongate member having opposing attachment zones; first and second opposing upper support columns and first and second opposing lower support columns each extending from a first end defining an attachment base and a second end, wherein the second end each of the upper support columns is sized for engaged receipt within a channel defined by the second end of the corresponding lower support column; each of the opposing upper support columns forming a plurality of apertures each being linearly displaced from each other; each of the opposing lower support columns forming a tension knob port; first and second tension knobs each having a protruding member sized and configured for engaged receipt with each of the plurality of apertures on the opposing upper support columns and the tension knob ports on the opposing lower support columns; first and second opposing base bars each having at least one attachment point; wherein the opposing attachment zones of the elongate member are sized and configured for selective attachment to each of the attachment bases of the opposing upper support columns and wherein each of the attachment bases of the opposing lower support columns is sized and configured for attachment to the corresponding at least one attachment points on the opposing base bars, defining a first configuration; and wherein the height of the elongate bar relative to the opposing base bars may be selectively adjusted when in the first configuration by aligning the tension knob ports with a correspondingly selected one of the plurality of linearly displaced apertures on the upper support column to form an aligned attachment channel that is sized and configured for engaged receipt of the tension knob for securing the elongate bar at a particular height relative to the opposing base bars.

In accordance with another form of the invention, there is provided an adjustable height balance beam including an elongate member having opposing attachment zones; first and second opposing upper support columns and first and second opposing lower support columns each extending from a first end defining an attachment base and a second end, wherein the respective upper and lower support columns are each structured and disposed for congruent receipt at respective second ends; first and second opposing base bars each having at least one attachment point; wherein the opposing attachment zones of the elongate member are sized and configured for selective attachment to each of the attachment bases of the opposing upper support columns and wherein each of the attachment bases of the opposing lower support columns is sized and configured for attachment to the corresponding at least one attachment points on the opposing base bars, defining a first configuration; wherein the opposing attachment zones of the elongate member are sized and configured for selective attachment to the respective at least one attachment points of the opposing base bars, defining a second configuration; and wherein the height of the elongate bar relative to the opposing base bars may be selectively adjusted between the first configuration and the second configuration.

BRIEF DESCRIPTION OF THE DRAWINGS

For a fuller understanding of the nature of the present invention, reference should be made to the following detailed description, taken in conjunction with the accompanying drawings in which.

DESCRIPTION OF THE PREFERRED EMBODIMENT(S)

Figure 1:
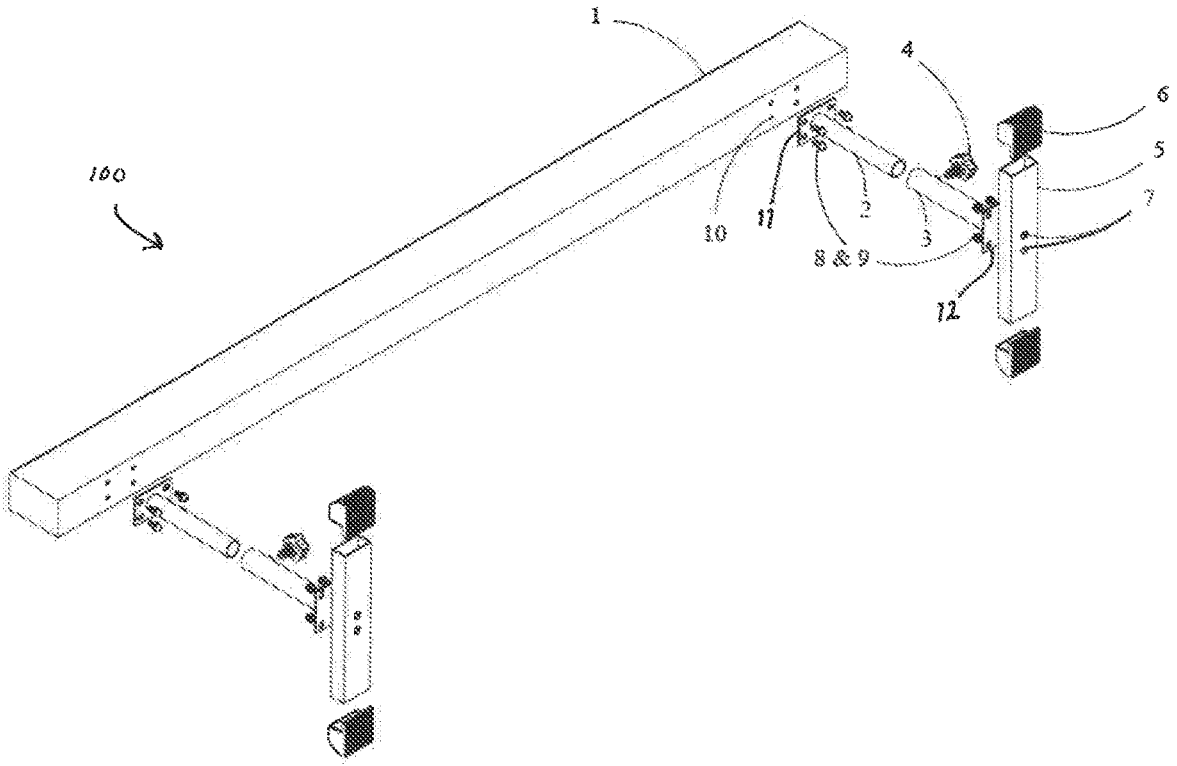
FIG. 1 is a perspective view of the adjustable height balance beam of the present invention in accordance with a first configuration.
Figure 2:
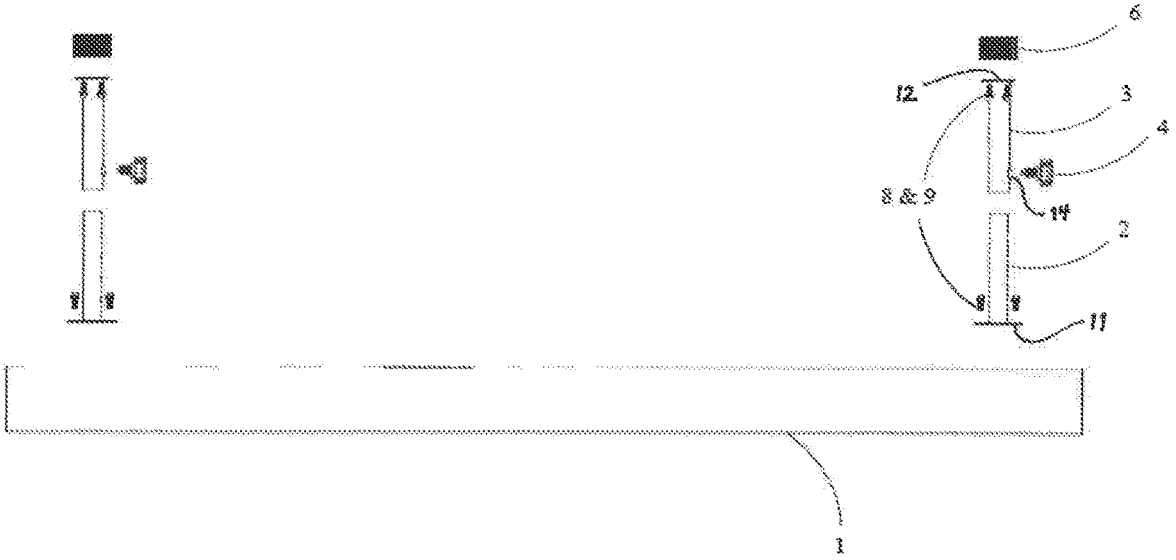
FIG. 2 is a side elevational view thereof.
Figure 3:
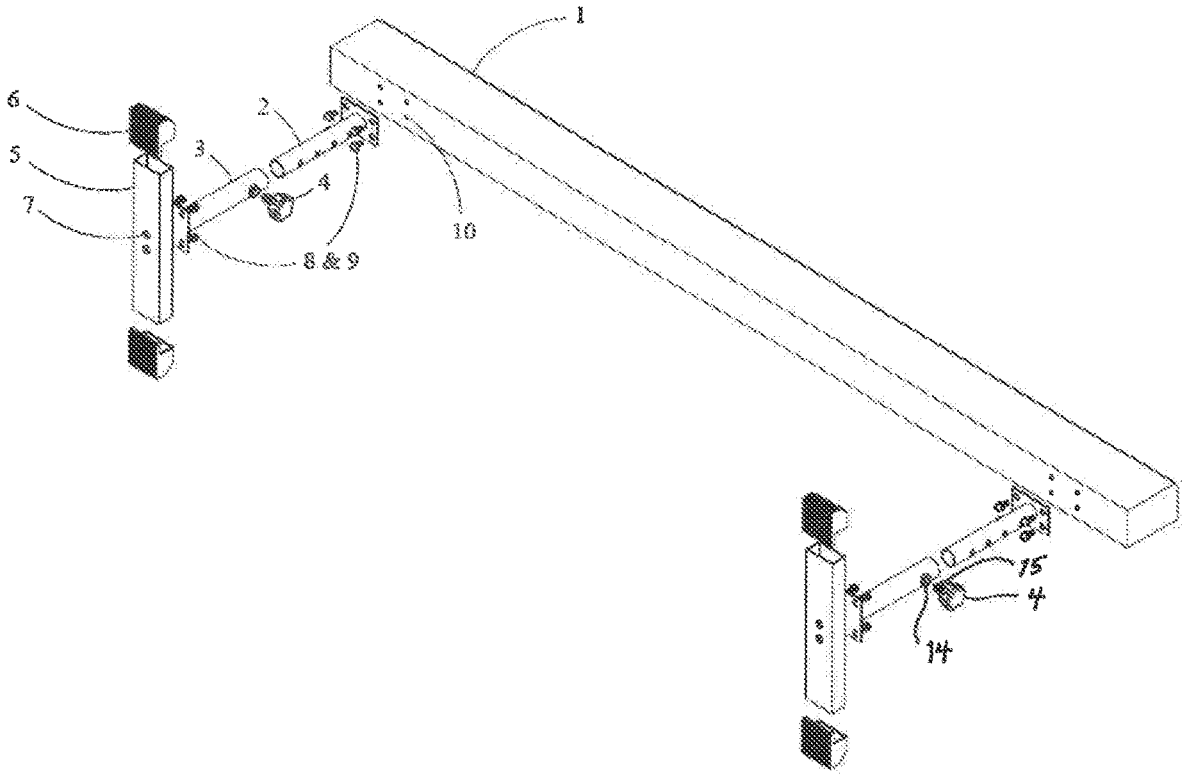
FIG. 3 is another perspective view thereof.
Figure 4:
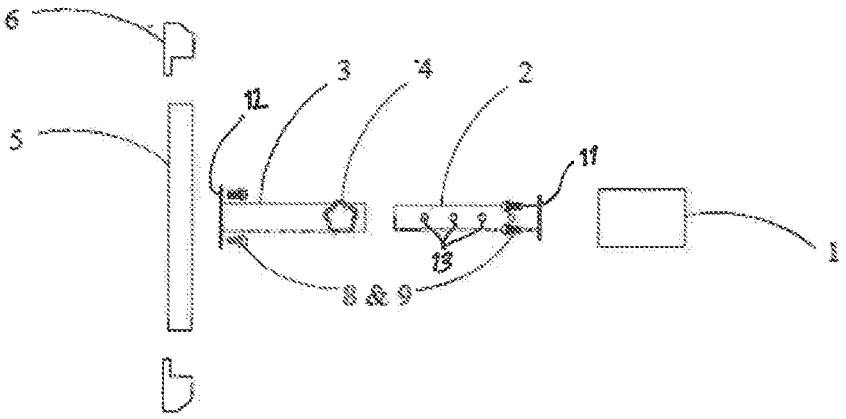
FIG. 4 is a front elevational view thereof.
Figure 5:
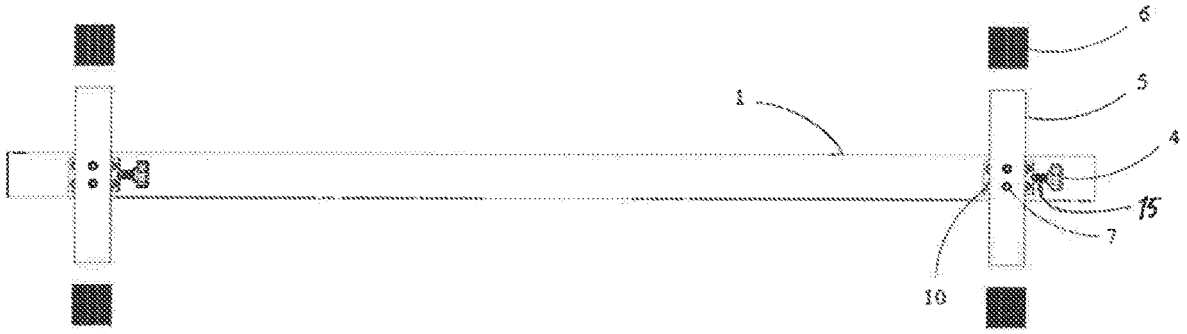
FIG. 5 is a bottom plan view thereof.
Figure 6:
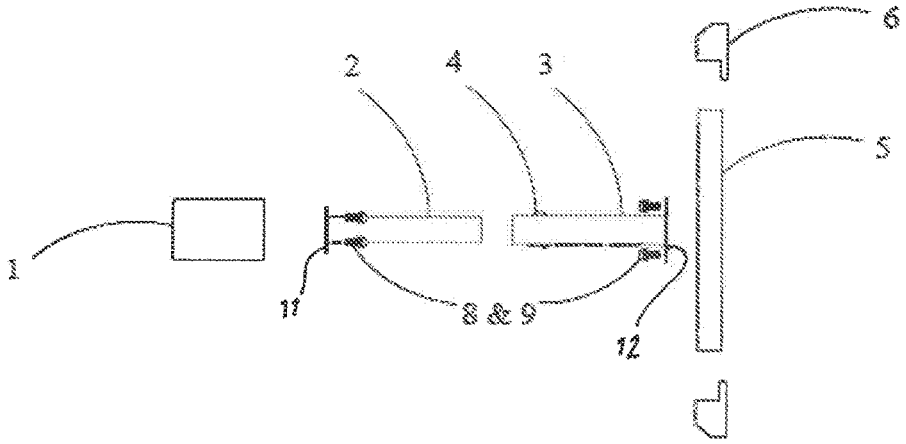
FIG. 6 is a rear elevational view thereof.
Figure 7:
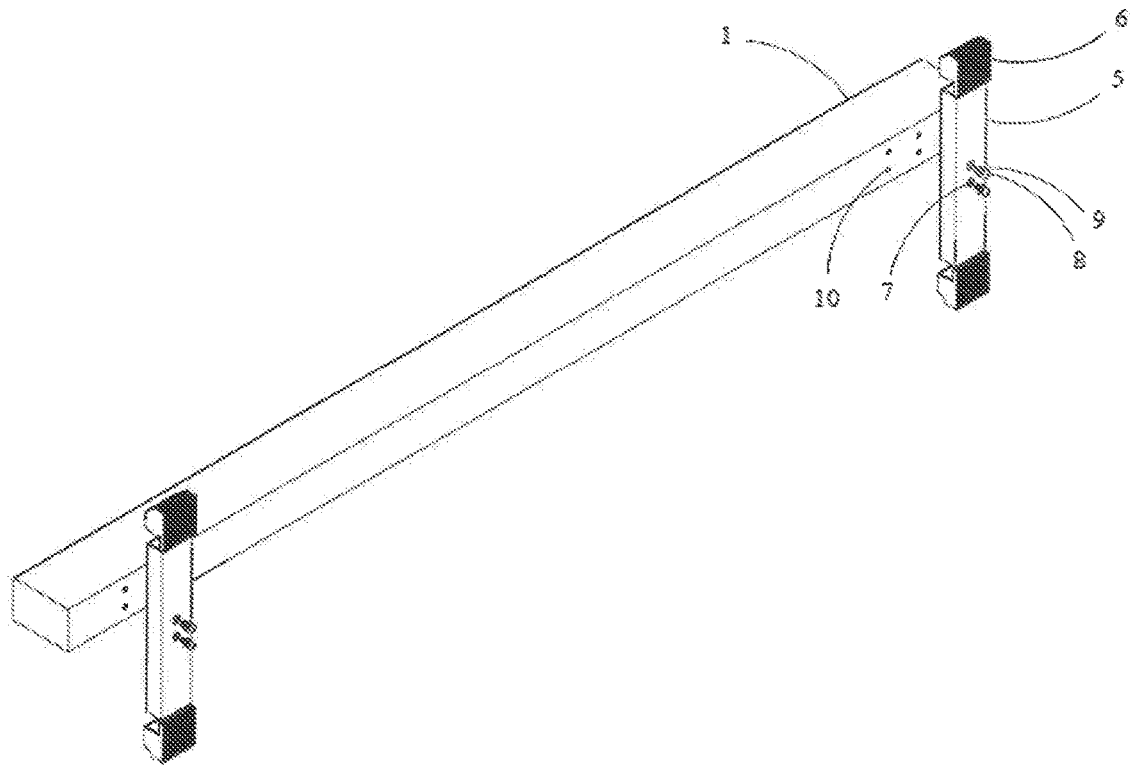
FIG. 7 is a perspective view of the adjustable height balance beam of the present invention in accordance with a second configuration.
Figure 8:
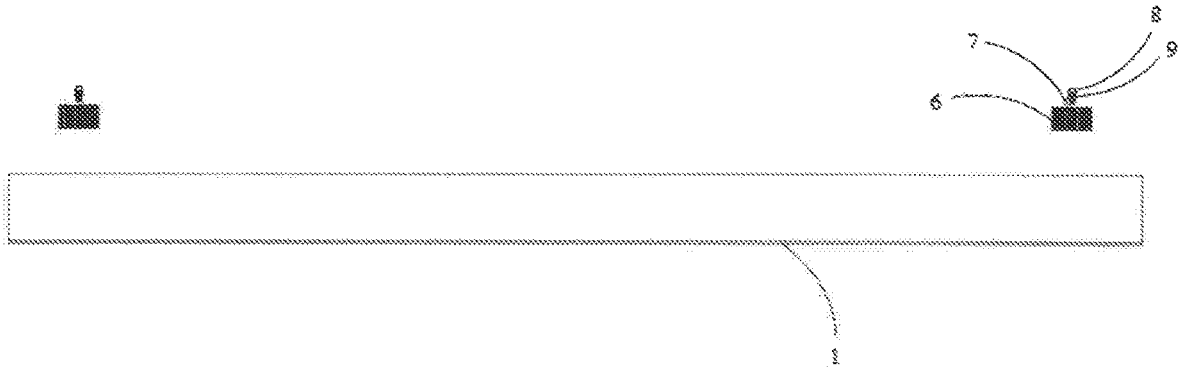
FIG. 8 is a side elevational view thereof.

Referring to the several views of the drawings, the adjustable height balance beam of the present invention is shown and is generally indicated as 100.

The adjustable height balance beam includes an elongate member 1 having opposing attachment zones 10. In one embodiment, the attachment zones 10 are apertures formed by the elongate member 1. Opposing upper and lower support columns 2 and 3 each extend from a first end being defined by respective attachment bases 11 and 12 and a second end, wherein the second ends of the opposing upper and lower support columns 2 and 3 are structured and disposed for congruent receipt. In one embodiment, the upper support column 2 is sized for engaged receipt within lower support column 3. Each of the opposing upper support columns 2 form a plurality of linearly displaced apertures 13 each being linearly displaced from each other. Each of the opposing lower support columns 3 form a tension knob port 14. A tension knob 4 includes a protruding member 15 sized and configured for engaged receipt within each of the plurality of apertures 13 on the opposing upper support columns 2 and the tension knob ports 14 on the opposing lower support columns 3 when the respective apertures 13 and tension knob ports 14 are in alignment.

Opposing base bars 5 each have at least one attachment point 7. The opposing attachment zones 10 of the elongate member 1 are sized and configured for selective attachment to each of the attachment bases 11 of the opposing upper support columns 2. Each of the attachment bases 12 of the opposing lower support columns 3 is sized and configured for attachment to corresponding opposing at least one attachment points 7 on the opposing base bars 5, thereby defining a first configuration. In one embodiment, the at least one attachment point 7 on opposing base bars 5 are beam access holes sized for engaged receipt of corresponding hex screws 8. A washer 9 may also be provided. The opposing attachment zones 10 of the elongate member 1 are also sized and configured for selective attachment to the respective at least one attachment points 7 of the opposing base bars 5, defining a second configuration, for selective height adjustment of the elongate bar 1 relative to the opposing base bars 5. In this second configuration, the at least one attachments point 7 on the opposing bars 5 are utilized for engaged receipt of corresponding hex screw and washers 8 and 9 for attachment of the base bars 5 to the elongate member 1.

When in the first configuration, the height of the elongate bar 1 relative to the opposing base bars 5 may be selectively adjusted by aligning the tension knob ports 14 with a correspondingly selected one of the plurality of linearly displaced apertures 13 on the upper support column 2 to form an aligned attachment channel that is sized and configured for engaged receipt of the tension knob 4 for securing the elongate bar 2 at a particular height relative to the opposing base bars 5.

In one embodiment, the opposing base bars 5 each have rubberized feet 6 for providing a friction surface to decrease movement of the base bars 5 relative to the ground surface.

The detailed description of the present disclosure encompasses a preferred embodiment but does not limit the many variations that can potentially be used in accordance with the spirit and scope of the novel objects and features as noted in the appended claims.

What is claimed is:

1. An adjustable height balance beam for use on a ground surface, the adjustable height balance beam comprising:

an elongate member having a top side and a bottom side, and opposing attachment zones on the bottom side, wherein the attachment zones and bottom side are on a first horizontal plane a first and second opposing upper support column and a first and second opposing lower support column, each upper and lower support column extending from a first end defining an attachment base and a second end, wherein the respective upper and lower support columns are each structured and disposed for congruent receipt at respective second ends;

each of the opposing lower support columns forming a tension knob port;

a first and second tension knob each having a protruding member sized and configured for engaged receipt with each of a plurality of apertures on the opposing upper support columns and the tension knob ports on the opposing lower support columns;

a first and second opposing base bar each having an elongated upper surface and at least one attachment point, wherein the attachment point and the elongated upper surface are on a second horizontal plane;

each of the first and second opposing base bars having a height;

the adjustable height balance beam being selectively operable between a first configuration and a second configuration;

wherein the opposing attachment zones of the elongate member are sized and configured for selective attachment to each of the attachment bases of the opposing upper support columns and wherein each of the attachment bases of the opposing lower support columns is sized and configured for attachment to the corresponding at least one attachment points on the opposing base bars, defining the first configuration;

wherein a distance between the elongate bar and the opposing base bars may be selectively adjusted when in the first configuration by aligning the tension knob ports with a correspondingly selected one of the plurality of linearly displaced apertures on the upper support column to form an aligned attachment channel that is sized and configured for engaged receipt of the tension knob for securing the elongate bar at a particular height relative to the opposing base bars; and wherein the opposing attachment zones of the elongate member are sized and configured for selective attachment to the respective at least one attachment points of the opposing base bars, such that the first and second horizontal plane are coplanar and wherein the bottom side of the elongate member is separated from the ground surface by a distance equal to the height of the opposing base bars, defining the second configuration.

2. The adjustable height balance beam as recited in claim 1 wherein each of the plurality of apertures are in linear alignment.

3. The adjustable height balance beam as recited in claim 1 wherein the second end of each of the upper support columns is sized for engaged receipt within a channel defined by the second end of the corresponding lower support column.

4. The adjustable height balance beam as recited in claim 1 wherein the opposing base bars each have at least one rubberized foot.

5. The adjustable height balance beam as recited in claim 1 wherein the opposing base bars each have first and second rubberized feet.

6. The adjustable height balance beam as recited in claim 1, wherein each first and second opposing upper support column is cylindrical, and each first and second opposing lower support column is cylindrical.

7. An adjustable height balance beam for use on a ground surface, the adjustable height balance beam comprising:

an elongate member having a top side and a bottom side, and opposing attachment zones on the bottom side, wherein the attachment zones and bottom side are on a same horizontal plane a first and second opposing upper support column and a first and second opposing lower support column, each upper and lower support column extending from a first end defining an attachment base and a second end, wherein the second end each of the upper support columns is sized for engaged receipt within a channel defined by the second end of the corresponding lower support column;

each of the opposing upper support columns forming a plurality of apertures each being linearly displaced from each other;

each of the opposing lower support columns forming a tension knob port;

a first and second tension knob each having a protruding member sized and configured for engaged receipt with each of the plurality of apertures on the opposing upper support columns and the tension knob ports on the opposing lower support columns;

a first and second opposing base bar each having an elongated upper surface and at least one attachment point, wherein the attachment point and the elongated upper surface are on a same second horizontal plane;

the adjustable height balance beam being selectively operable between a first configuration and a second configuration;

wherein the opposing attachment zones of the elongate member are sized and configured for selective attachment to each of the attachment bases of the opposing upper support columns and wherein each of the attachment bases of the opposing lower support columns is sized and configured for attachment to the corresponding at least one attachment points on the opposing base bars, defining the first configuration; and wherein a distance between the elongate bar and the opposing base bars may be selectively adjusted when in the first configuration by aligning the tension knob ports with a correspondingly selected one of the plurality of linearly displaced apertures on the upper support column to form an aligned attachment channel that is sized and configured for engaged receipt of the tension knob for securing the elongate bar at a particular height relative to the opposing base bars; and wherein the opposing attachment zones of the elongate member are sized and configured for selective attachment to the respective at least one attachment points of the opposing base bars, such that the first and second horizontal plane are coplanar and wherein the bottom side of the elongate member is separated from the ground surface by a distance equal to the height of the opposing base bars, defining the second configuration.

8. The adjustable height balance beam as recited in claim 7 wherein the opposing base bars each have at least one rubberized foot.

9. The adjustable height balance beam as recited in claim 7 wherein the opposing base bars each have first and second rubberized feet.

10. The adjustable height balance beam as recited in claim 7, wherein each first and second opposing upper support column is cylindrical, and each first and second opposing lower support column is cylindrical.

11. An adjustable height balance beam for use on a ground surface, the adjustable height balance beam comprising:

an elongate member having a top side and a bottom side, and opposing attachment zones on the bottom side, wherein the attachment zones and bottom side are on a same horizontal plane a first and second opposing upper support column and a first and second opposing lower support column, each upper and lower support column extending from a first end defining an attachment base and a second end, wherein the respective upper and lower support columns are each structured and disposed for congruent receipt at respective second ends;

a first and second opposing base bar each having an elongated upper surface and at least one attachment point, wherein the attachment point and the elongated upper surface are on a same second horizontal plane;

the adjustable height balance beam being selectively operable between a first configuration and a second configuration;

wherein the opposing attachment zones of the elongate member are sized and configured for selective attachment to each of the attachment bases of the opposing upper support columns and wherein each of the attachment bases of the opposing lower support columns is sized and configured for attachment to the corresponding at least one attachment points on the opposing base bars, defining the first configuration;

wherein the opposing attachment zones of the elongate member are sized and configured for selective attachment to the respective at least one attachment points of the opposing base bars, such that the first and second horizontal plane are coplanar and wherein the bottom side of the elongate member is separated from the ground surface by a distance equal to the height of the opposing base bars, defining the second configuration.

12. The adjustable height balance beam as recited in claim 11 wherein the second end of each of the upper support columns is sized for engaged receipt within a channel defined by the second end of the corresponding lower support column.

13. The adjustable height balance beam as recited in claim 11 wherein the opposing base bars each have at least one rubberized foot.

14. The adjustable height balance beam as recited in claim 11 wherein the opposing base bars each have first and second rubberized feet.

15. The adjustable height balance beam as recited in claim 11, wherein each first and second opposing upper support column is cylindrical, and each first and second opposing lower support column is cylindrical.

* * * * *